US008388383B2

(12) United States Patent
Tsai et al.

(10) Patent No.: US 8,388,383 B2
(45) Date of Patent: Mar. 5, 2013

(54) POWER ADAPTOR STRUCTURE

(75) Inventors: An-Gu Tsai, Taipei (TW); Yu-Han Tai, Keelung (TW)

(73) Assignee: Longwell Company, Taipei (TW)

( * ) Notice: Subject to any disclaimer, the term of this patent is extended or adjusted under 35 U.S.C. 154(b) by 0 days.

(21) Appl. No.: 13/279,879

(22) Filed: Oct. 24, 2011

(65) Prior Publication Data

US 2012/0322312 A1 Dec. 20, 2012

(30) Foreign Application Priority Data

Jun. 16, 2011 (TW) ..... 100210897 U

(51) Int. Cl.
*H01R 31/06* (2006.01)

(52) U.S. Cl. ..... 439/628

(58) Field of Classification Search ..... 439/626–628, 439/638–639, 131, 541.5, 542
See application file for complete search history.

(56) References Cited

U.S. PATENT DOCUMENTS

| | | | | |
|---|---|---|---|---|
| 3,864,000 | A * | 2/1975 | Coller et al. | 439/246 |
| 5,628,641 | A * | 5/1997 | Hahn | 439/131 |
| 6,033,258 | A * | 3/2000 | Huang et al. | 439/541.5 |
| 6,171,129 | B1 * | 1/2001 | Phillips | 439/346 |
| 7,351,097 | B2 * | 4/2008 | Hsu | 439/541.5 |
| 7,510,430 | B2 * | 3/2009 | Zhang et al. | 439/541.5 |
| 7,798,825 | B1 * | 9/2010 | Pai | 439/131 |
| 2002/0173187 | A1 * | 11/2002 | Schmitt | 439/171 |

* cited by examiner

*Primary Examiner* — Chandrika Prasad
(74) *Attorney, Agent, or Firm* — Muncy, Geissler, Olds & Lowe, PLLC

(57) ABSTRACT

A power adaptor structure comprises a plug member, a conversion member, a fixing member and a front cover. The plug member is joined to and electrically connected with the conversion member. After passing through the plug member and the conversion member, the fixing member is secured to the conversion member. The front cover is press-fitted with a front side of the conversion member to form a power adaptor structure having an input side and an output side. The power adaptor structure of the present invention is easy to assemble and has enhanced strength.

10 Claims, 7 Drawing Sheets

POWER ADAPTOR STRUCTURE

BACKGROUND OF THE INVENTION

1. Field of the Invention

The present invention relates to a power plug technology, particularly to a high-reliability power adaptor structure.

2. Description of the Prior Art

The functions of computers are increasing and advancing rapidly, and more and more peripheral devices are used to serve computers. Peripheral devices are normally equipped with power adaptors. In fabrication of a power adaptor, the internal components are usually installed in the internal structure beforehand, and an insulating housing is then used to encapsulate the internal assemblage. The structure and package of the conventional power adaptor needs a grounding plate to connect terminals with wires. Besides, the terminals of the conventional power adaptor are likely to shrink into the housing when plugged in or pulled out.

SUMMARY OF THE INVENTION

In order to solve aforementioned problems, one objective of the present invention is to provide a power adaptor structure, wherein a fixing member is used to fix the plug member and the conversion member, whereby is simplified assemblage and stabilized structure, wherefore are overcome the abovementioned problems.

To achieve the abovementioned objective, the present invention proposes a power adaptor structure, which comprises a plug member, a conversion member, a fixing member and a front cover. The plug member includes an insert-molded frame and at least two conductive pins set therein, wherein a first passageway is formed on the insert-molded frame; and each of the conductive pins has a mating portion, a retaining portion, and an inner contact portion, and wherein the retaining portion is engaged with the insert-molded frame; the mating portion is extending out of a front side of the insert-molded frame; and the inner contact portion is extending out of a rear side of the insert-molded frame. The conversion member is electrically connected with the plug member. The conversion member includes a rear casing, an electric-connection structure, and an insulating casing. The rear casing has a first accommodation space, wherein a positioning tube is formed inside the first accommodation space. The rear part of the insulating casing is butt-joined with the rear casing, wherein a plurality of terminal through-holes and a second passageway are formed on the rear part of the insulating casing. The electric-connection structure is arranged inside the first accommodation space of the rear casing. After assemblage, a portion of the electric-connection structure protrudes from the first accommodation space, and wherein another portion of the electric-connection structure is electrically connected to the inner contact portions of the conductive pins. The fixing member is arranged in the insert-molded frame. After passing through the first passageway and the second passageway, the fixing member is secured to the positioning tube of the rear casing. The front cove is arranged on the front side of the insert-molded frame. The front cover is press-fitted with a front side of the insulating casing and reveals the mating portions of the conductive pins.

Below, the embodiments are described in detail in cooperation with the attached drawings to make easily understood the objectives, technical contents, characteristics and accomplishments of the present invention.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DETAILED DESCRIPTION OF THE INVENTION

The present invention is described with the embodiments below. However, it should be understood that the embodiments are only to exemplify the present invention but not to limit the scope of the present invention.

Figure 1:
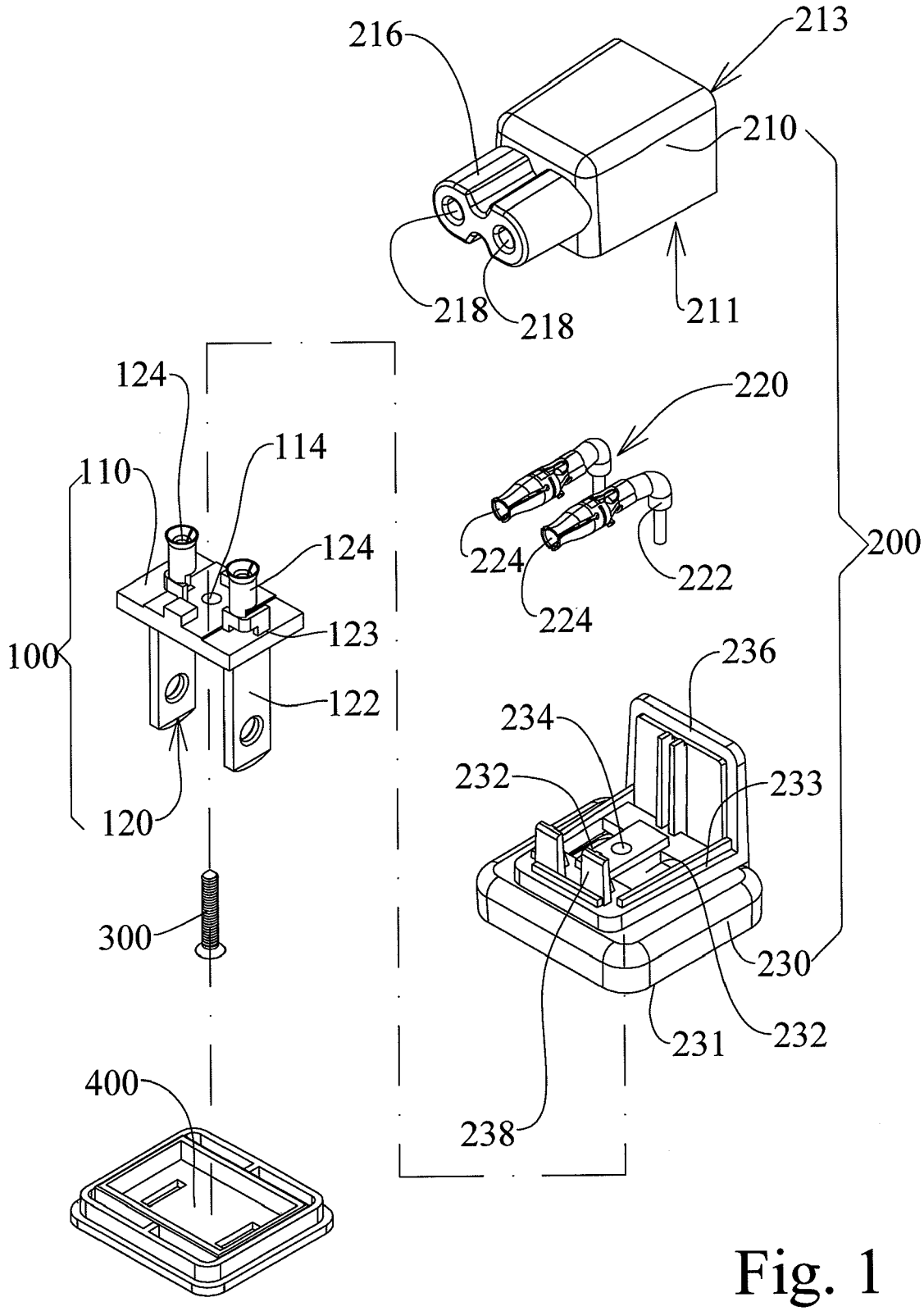
FIG. 1 is an exploded view of a power adaptor structure according to one embodiment of the present invention.
Figure 2A:
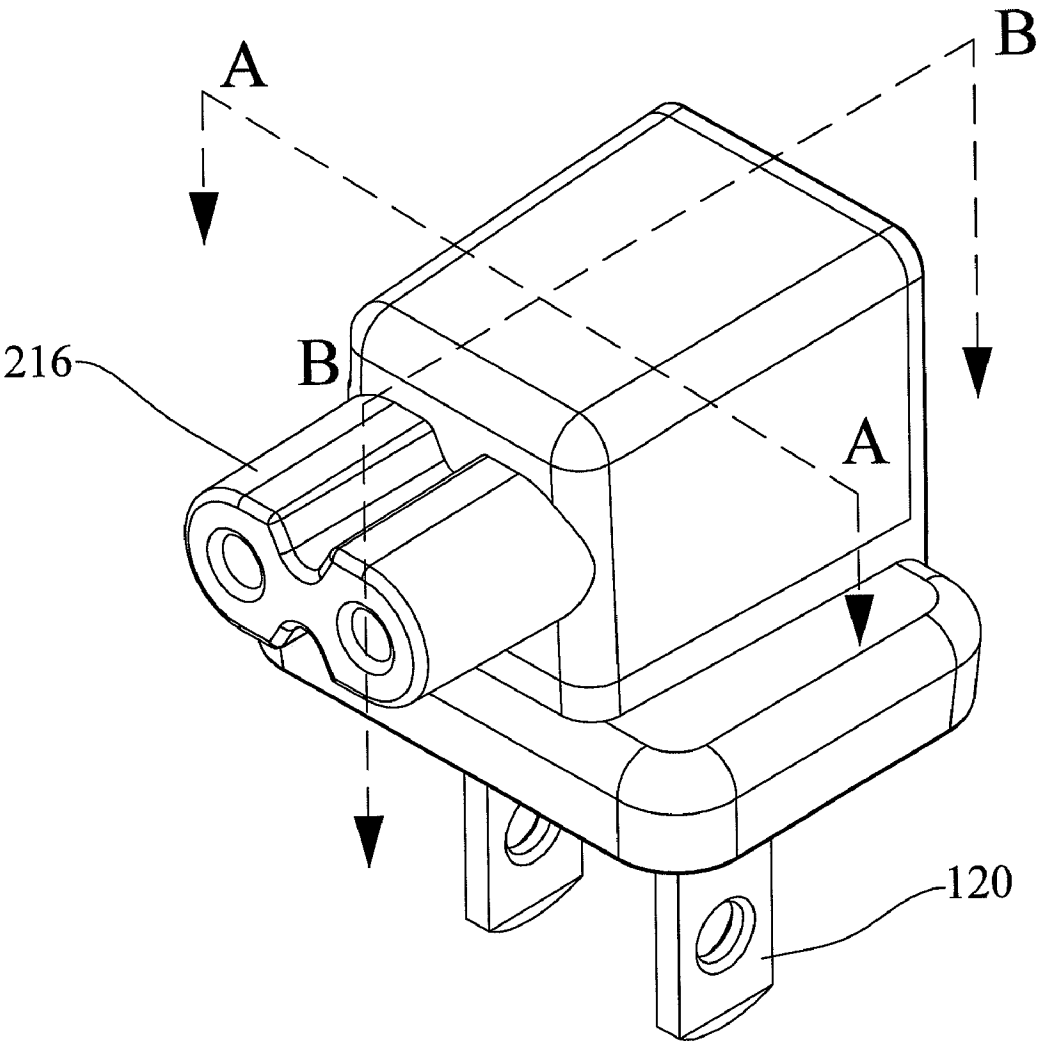
FIG. 2A schematically shows an assembled power adaptor structure according to one embodiment of the present invention.

FIG. 1 is an exploded view of a power adaptor structure according to one embodiment of the present invention; and FIG. 2A schematically shows an assembled power adaptor structure according to one embodiment of the present invention. Refer to FIG. 1 firstly, the power adaptor structure of the present invention comprises a plug member 100, a conversion member 200, a fixing member 300 and a front cover 400, wherein the plug member 100 is electrically connected with the conversion member 200; and the fixing member 300 is used to fix the plug member 100 and the conversion member 200. After that, the front cover 400 is press-fitted with the conversion member 200 to form a power adaptor structure having an input side and an output side, as shown in FIG. 2A, wherein the power adaptor structure is arranged to L-like in shape.

Figure 2B:
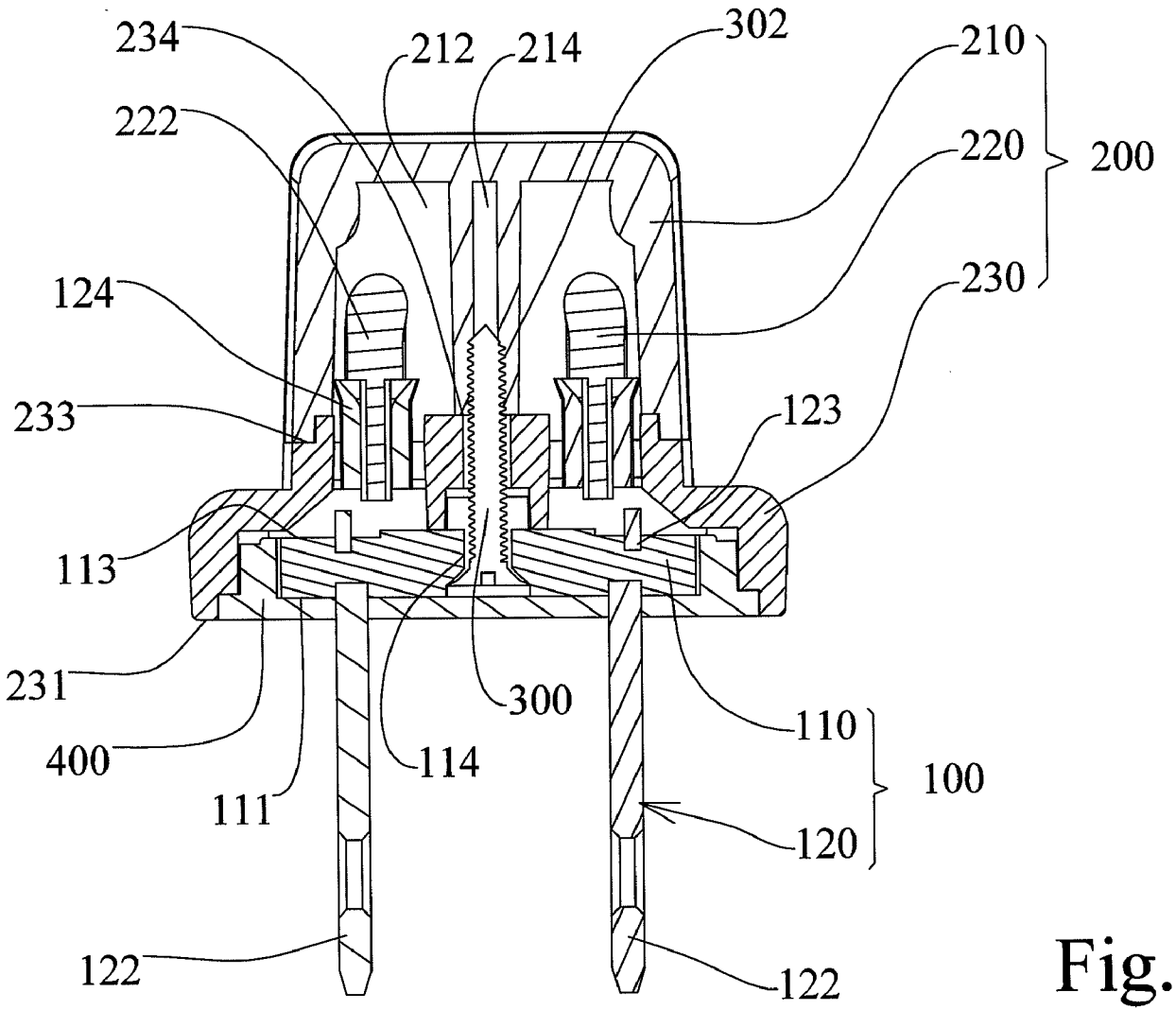
FIG. 2B is a sectional view taken along Line A-A in FIG. 2A.
Figure 3A:
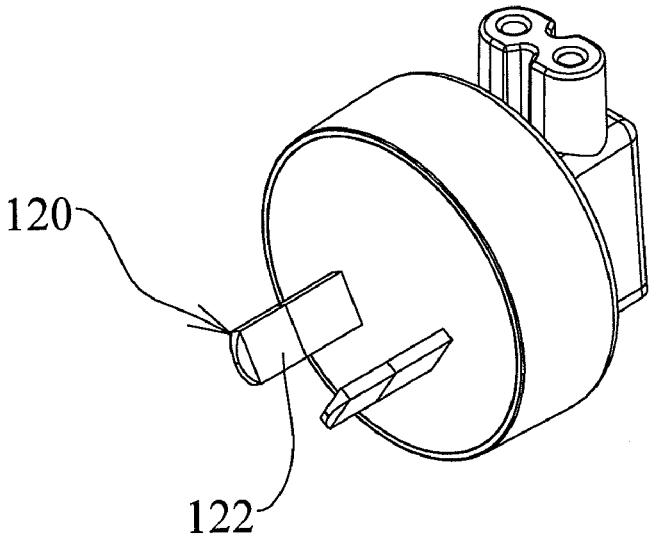
FIGS. 3A-3C and FIGS. 4A and 4B schematically show conductive pins according to different embodiments of the present invention.
Figure 3B:
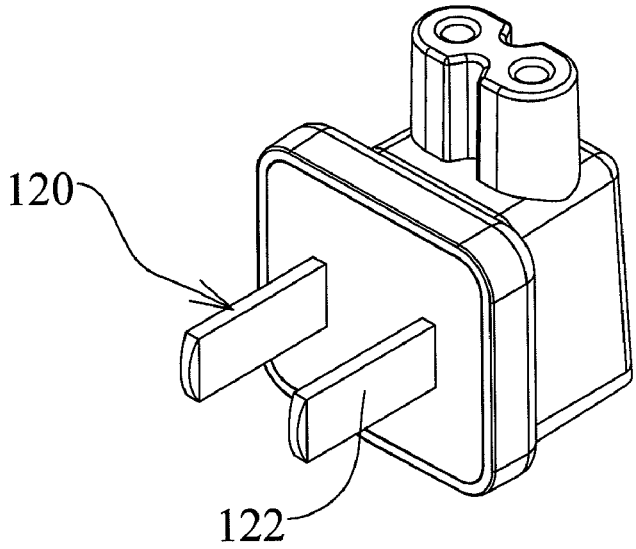
Figure 3C:
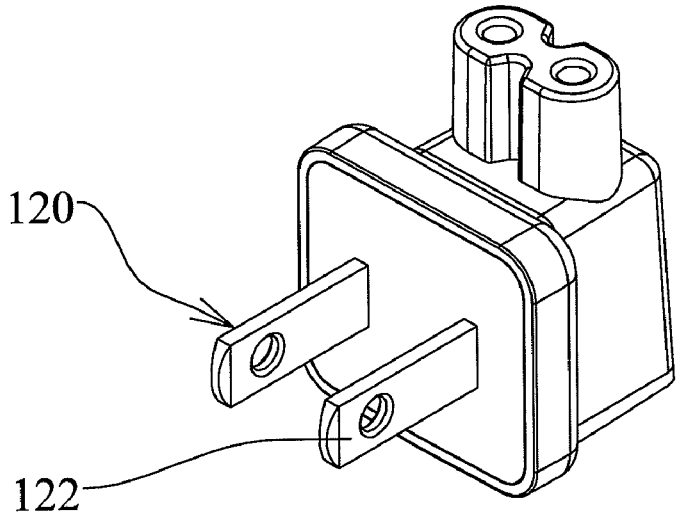
Figure 4A:
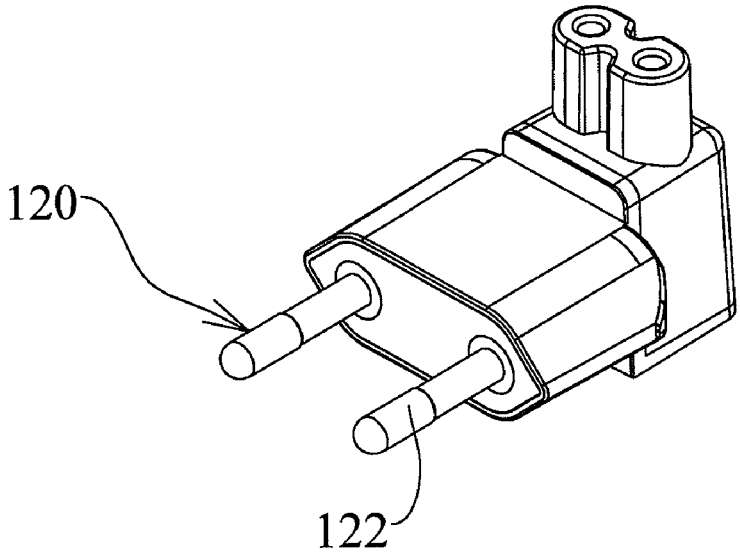
Figure 4B:
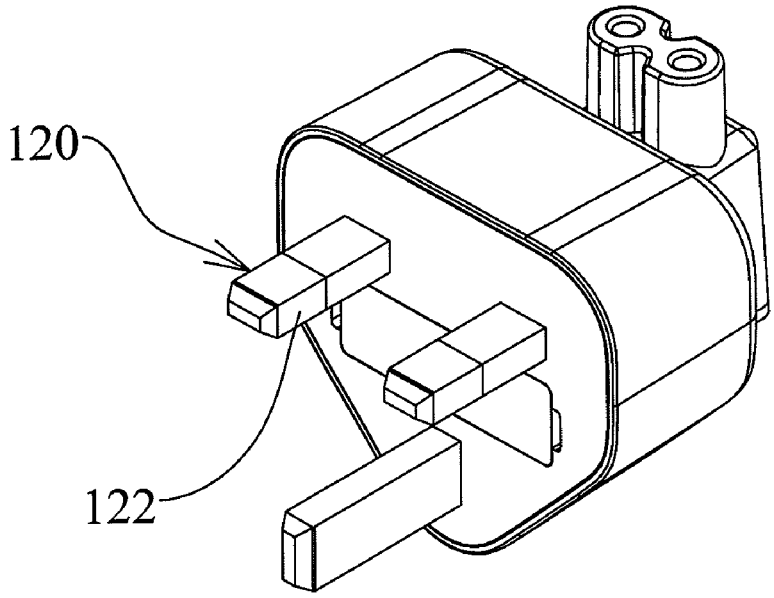

Continuously, the detail structure of the plug member 100 is illustrated in FIG. 1 and FIG. 2B, wherein FIG. 2B is a sectional view taken along Line A-A in FIG. 2A. As shown in these two figures, the plug member 100 includes an insert-molded frame 110 and at least two conductive pins 120 set therein. The insert-molded frame 110 has a plate-like body, and a first passageway 114 is formed on the insert-molded frame 110. Each of the conductive pins 120 has a mating portion 122, a retaining portion 123, and an inner contact portion 124, wherein the retaining portion 123 is engaged with the insert-molded frame 110; the mating portion 122 is extending out of a front side 111 of the insert-molded frame 110; and the inner contact portion 124 is extending out of a rear side 113 of the insert-molded frame 110. In one embodiment, the mating portion 122 of the conductive pin 120 may have a plate-like shape (as shown in FIGS. 3A-3C), a pillar shape (as shown in FIG. 2A and FIG. 4A) or a bar shape (as shown in FIG. 4B). It should be understood that the appearances and structures of the conductive pin 120 of the present invention include but are not limited to those shown in the drawings. In the present invention, the conductive pin 120 may be fabricated according to the specifications of the safety regulations of all nations.

Figure 2C:
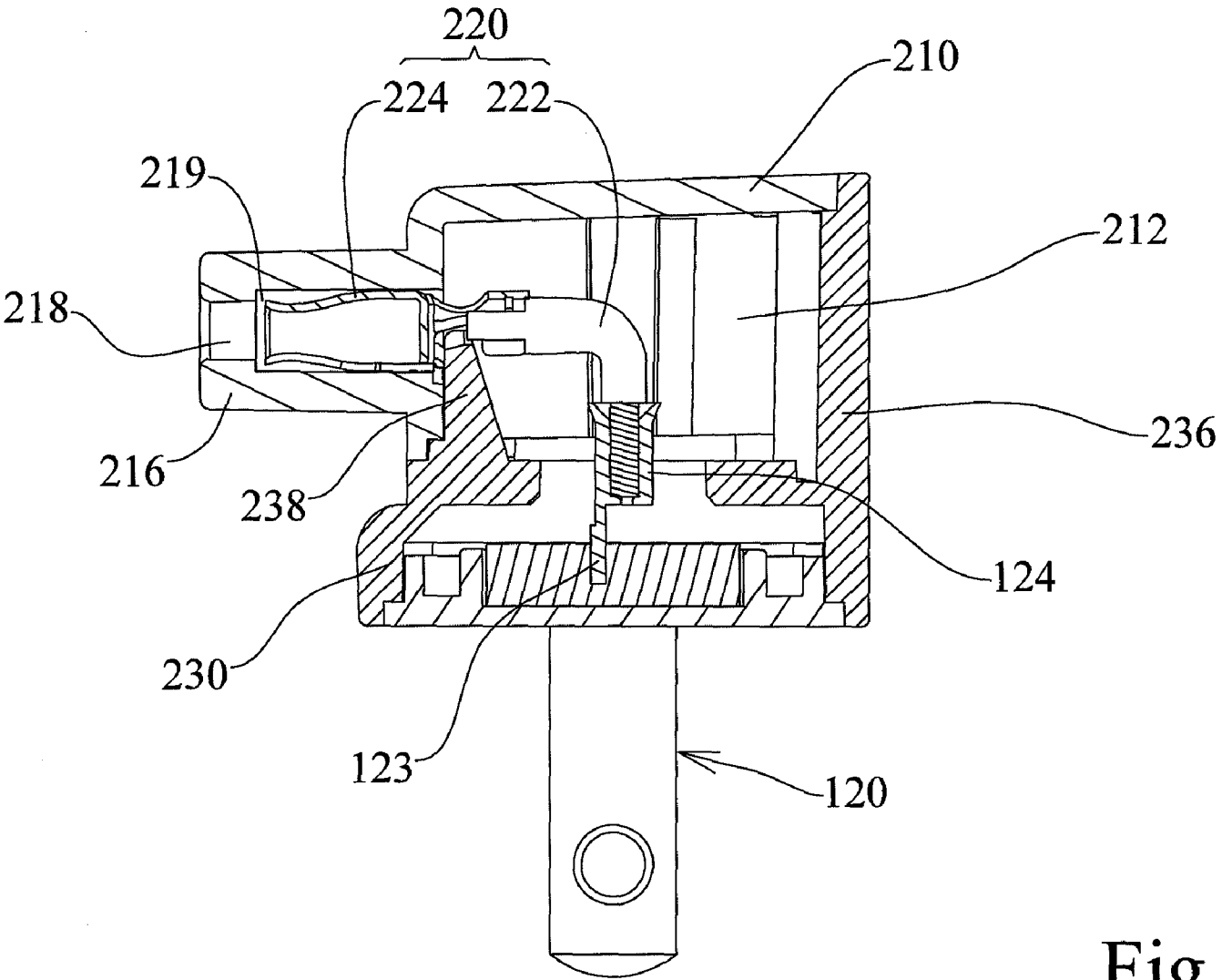
FIG. 2C is a sectional view taken along Line B-B in FIG. 2A.
Figure 5:
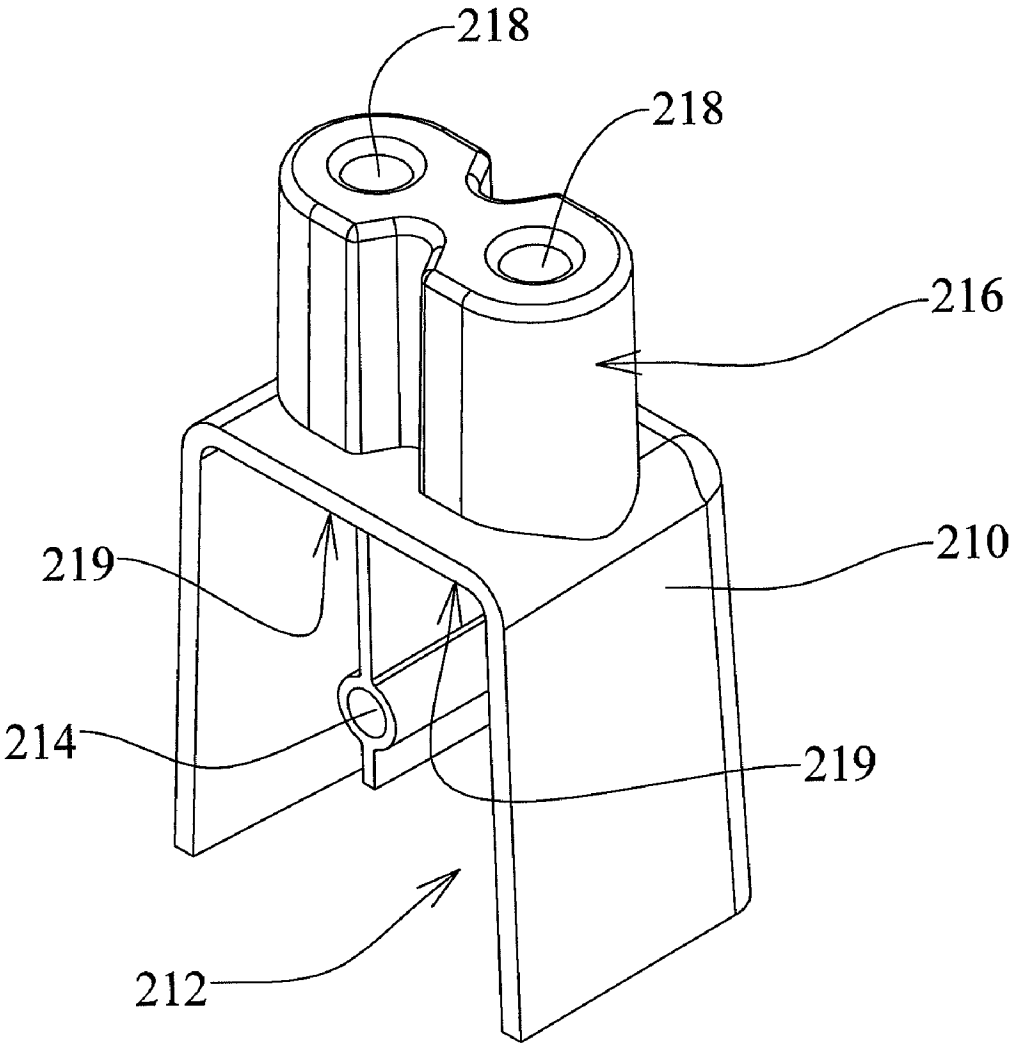
FIG. 5 is a perspective view taken from another viewing angle of a rear casing according to one embodiment of the present invention.

In continuation to the above descriptions, referring to FIG. 1 again, the conversion member 200 is joined to and electrically connected with the plug member 100, and the conversion member 200 includes a rear casing 210, an electric-connection structure 220, and an insulating casing 230. The detailed structure in each element is described in the following. Refer to FIG. 1 and FIG. 5 first, FIG. 5 is a perspective view taken from another viewing angle of the rear casing 210. The rear casing 210 has a first accommodation space 212, and a positioning tube 214 is formed inside the first accommodation space 212. Refer to FIG. 2C, FIG. 2C is a sectional view taken along Line B-B in FIG. 2A, in one embodiment, a socket member 216 protrudes from one side surface of the rear casing 210, wherein the socket member 216 has a plurality of socket holes 218 and a first sub-accommodation space 219 interconnecting with the socket holes 218. Besides, refer to FIG. 1 and FIG. 2B again. A rear part 233 of the insulating casing 230 is butt-joined with the rear casing 210. A plurality of terminal through-holes 232 and a second passageway 234 are arranged on the rear part 233 of the insulating casing 230. In one embodiment, two terminal through-holes 232 are separately disposed at two sides of the second passageway 234 for receiving the conductive pins 120. Moreover, the electric-connection structure 220 is arranged inside the first accommodation space 212 of the rear casing 210. After assemblage, a portion of the electric-connection structure 220 protrudes from the first accommodation space 212 and is accommodated in the first sub-accommodation space 219; and another portion of the electric-connection structure 220 is electrically connect to the inner contact portions 124 of the conductive pins 120. In one embodiment, the electric-connection structure 220 is a crimp-type electric-connection structure, as shown in FIG. 1, and the crimp-type electric-connection structure includes wires 222 and female terminals 224. As illustrated in FIG. 2B, one end of the wire 222 is crimped and gripped to the inner contact portion 124 of the conductive pin 120; and as shown in FIG. 2C, the other end of the wire 222 is crimped and gripped to the female terminal 224. The cost of the power adaptor structure is effectively reduced via connecting the wires 222 to the female terminals 224 or connecting the wires 222 to the conductive pins 120 in a crimping way.

Refer to FIG. 1 and FIG. 2C again, in one embodiment, a plate-like protrusion 236 protrudes from one side of the rear part 233 of the insulating casing 230. The rear casing 210 has a first opening 211 and a second opening 213 adjacent to the first opening 211. The first opening 211 is butt-joined with the rear part 233 of the insulating casing 230. The second opening 213 is butt-joined with the plate-like protrusion 236 of the insulating casing 230.

In the embodiment illustrated in FIG. 1 and FIG. 2B, the fixing member 300 is arranged in the insert-molded frame 110. After passing through the first passageway 114 of the insert-molded frame 110 and the second passageway 234 of the insulating casing 230, the fixing member 300 is secured to the positioning tube 214 of the rear casing 210. In one embodiment illustrated in FIG. 2B, the fixing member 300 has a male threaded portion 302, and the male threaded portion 302 is utilized to screw into the positioning tube 214 so as to fasten the power adaptor structure. After that, the front cover 400 is arranged on the front side 111 of the insert-molded frame 110, wherein the front cover 400 is press-fitted to a front side 231 of the insulating casing 230 and reveals the mating portions 122 of the conductive pins 120. The assembled power adaptor structure of the present invention is shown in FIG. 2A. The power input direction (the direction of the conductive pins 120) and the power output direction (the direction of the socket member 216) are arranged to form an L-shape structure. It should be understood that the L-shape structure in FIG. 2A is only an embodiment to exemplify the present invention. The power adaptor structure of the present invention may also be fabricated to have other shapes meeting the power plug regulations of other nations, such as China, Europe, Korea, Brazil, Australia, England, and Argentina.

In one embodiment illustrated in FIG. 1 and FIG. 2C, in order to increase the durability of the power adaptor structure of the present invention, at least one positioning protrusion 238 protrudes from one side of the rear part 233 of the insulating casing 230 toward the interior of the rear casing 210, propping the electric-connection structure 220.

The present invention is characterized in embedding the conductive pins and the insert-molded frame between the outer and inner molds in injection-molding to fix the conductive pins to the insert-molded frame. Therefore, the present invention can be easily fabricated without using any auxiliary component, such as a grounding plate. Further, the present invention can prevent the conductive pins from detaching from the insert-molded frame after the power adaptor has been plugged in and pulled out many times. Besides, the conductive pins of the present invention have crimp-grip structures, whereby the wires can be crimped and gripped to the conductive pins, wherefore is simplified fabrication and reduced cost.

In summary, the present invention proposes a power adaptor structure, wherein a fixing member is used to fix the plug member and the conversion member, whereby is simplified assemblage and stabilized structure.

The embodiments described above are to demonstrate the technical contents and characteristics of the present invention to enable the persons skilled in the art to understand, make, and use the present invention. However, it is not intended to limit the scope of the present invention. Therefore, any equivalent modification or variation according to the spirit of the present invention is to be also included within the scope of the present invention.

What is claimed is:

1. A power adaptor structure comprising:

a plug member including an insert-molded frame and at least two conductive pins set therein, wherein a first passageway is formed on said insert-molded frame; and each of said conductive pins has a mating portion, a retaining portion, and an inner contact portion, and wherein said retaining portion is engaged with said insert-molded frame; said mating portion is extending out of a front side of said insert-molded frame; and said inner contact portion is extending out of a rear side of said insert-molded frame;

a conversion member electrically connected with said plug member and including:

a rear casing having a first accommodation space, wherein a positioning tube is formed inside said first accommodation space;

an insulating casing with a rear part thereof butt-joined to said rear casing, wherein a plurality of terminal through-holes and a second passageway are formed on said insulating casing at said rear part; and an electric-connection structure arranged inside said first accommodation space of said rear casing and partially protruding from said first accommodation space, and wherein another portion of said electric-connection structure is electrically connected with said inner contact portions of said conductive pins;

a fixing member arranged in said insert-molded frame and inserted through said first passageway and said second passageway to engage with said positioning tube of said rear casing; and a front cover arranged on said front side of said insert-molded frame, and press-fitted with a front side of said insulating casing, wherein said mating portions of said conductive pins are exposed outside said front cover.

2. The power adaptor structure according to claim 1, wherein each said conductive pin has a plate-like shape, a pillar shape or a bar shape.

3. The power adaptor structure according to claim 1, wherein said electric-connection structure is a crimp-type electric-connection structure, and wherein said crimp-type electric-connection structure includes wires and female terminals, wherein one end of said wire is crimped and gripped to said inner contact portion of said conductive pin, and wherein another end of said wire is crimped and gripped to said female terminal.

4. The power adaptor structure according to claim 1, wherein a plate-like protrusion protrudes from one side of said rear part of said insulating casing.

5. The power adaptor structure according to claim 4, wherein said rear casing has a first opening and a second opening adjacent to said first opening, and wherein said first opening is butt-joined with said rear part of said insulating casing, and wherein said second opening is butt-joined with said plate-like protrusion of said insulating casing.

6. The power adaptor structure according to claim 1, wherein a socket member protrudes from one side surface of said rear casing, and wherein said socket member has a plurality of socket holes and a first sub-accommodation space interconnecting with said socket holes, and wherein a portion of said electric-connection structure is arranged inside said first sub-accommodation space of said rear casing.

7. The power adaptor structure according to claim 1, wherein said power adaptor structure is arranged to L-like in shape.

8. The power adaptor structure according to claim 1, wherein said fixing member has a male threaded portion.

9. The power adaptor structure according to claim 8, wherein said male threaded portion is screwed into said positioning tube.

10. The power adaptor structure according to claim 1, wherein said terminal through-holes are separately disposed at two sides of said second passageway for receiving said conductive pins.

* * * * *